United States Patent [19]

Busse et al.

[11] Patent Number: 4,651,963

[45] Date of Patent: Mar. 24, 1987

[54] APPLIANCE MOUNTING SYSTEM

[75] Inventors: Gary W. Busse; Jerome Tronnes, both of Champlin, Minn.

[73] Assignee: Litton Systems, Inc., Beverly Hills, Calif.

[21] Appl. No.: 739,989

[22] Filed: May 31, 1985

[51] Int. Cl.[4] ..... A47H 1/10

[52] U.S. Cl. ..... 248/323; 248/309.1; 248/491

[58] Field of Search ..... 248/317, 323, 312.1, 248/201, 298, 124, 205.1, 223.3, 309.1, 274, 279, 298, 27.1, 27.3, 316.4, 313, 490, 491, 480, 468; 40/155; 70/461; 312/245, 140.4

[56] References Cited

U.S. PATENT DOCUMENTS

| | | | |
|---|---|---|---|
| 1,050,235 | 1/1913 | Scanlan | 248/298 |
| 1,410,186 | 3/1922 | Jassen | 248/491 X |
| 2,325,712 | 8/1943 | Shurmur | 248/313 |
| 2,338,172 | 1/1944 | Firks | 40/155 |
| 3,268,190 | 8/1966 | Hansen | 248/27.1 |
| 3,420,289 | 1/1969 | Bejarano | 248/298 X |
| 3,590,510 | 7/1971 | Salz | 40/155 |
| 3,965,705 | 6/1976 | Nadler | 248/553 X |
| 4,055,319 | 10/1977 | Pendock | 248/491 |
| 4,073,082 | 2/1978 | McWhorter | 40/155 X |

*Primary Examiner*—Ramon O. Ramirez

*Attorney, Agent, or Firm*—Walter R. Thiel; John M. Haurykiewicz

[57] ABSTRACT

A mounting system for suspending an appliance from an overhanging structure and, particularly, for suspending an appliance of the type having a housing including an upper surface and projecting rims extending away from the housing of opposite edges of the upper surface. The system includes a first bracket for attachment to the overhanging structure, the first bracket including a first lip for supporting one of the upper surface rims. A second bracket is in telescoping relation to the first bracket and includes a second lip for supporting the other of the upper surface rims. The first and second brackets are resiliently urged toward each other while the relative movement between the brackets is regulated. In a preferred embodiment, the relative movement between the first and second bracket is restricted by stops and prevented by a locking mechanism.

15 Claims, 5 Drawing Figures

APPLIANCE MOUNTING SYSTEM

BACKGROUND OF THE INVENTION

1. Field of the Invention.

The present invention relates to a mounting system for suspending an appliance from an overhanging structure and particularly, to a mounting system for suspending an appliance from and beneath a wall mounted cabinet.

2. Description of the Prior Art.

Modern electrical appliances are increasing in number and description. The proliferation of kitchen appliances, in particular, poses a problem in that they are often difficult, if not impossible, to store between uses (microwave ovens, for example) while nearly all require countertop space during use. In some instances, this has been addressed by mounting a microwave oven above a conventional oven by brackets extending from the conventional oven. In other instances, electric coffee makers and other similar items have been suspended beneath the cabinets of the kind typically found within a kitchen. In the latter case, the brackets are required to suspend only fairly light items. In contrast, the smallest microwave oven may have a weight of approximately one hundred pounds.

SUMMARY OF THE INVENTION

The present invention provides a mounting system for suspending an appliance from an overhanging structure such as a kitchen cabinet. The mounting system has particular application for mounting microwave ovens although it is easily adaptable to the suspension of other appliances. In any case, by suspending the appliance from an overhanging structure such as a wall kitchen cabinet, counter space is freed for use during food preparation and/or the support or storage of another appliance.

The mounting system of the present invention is intended for use with an appliance of the type having a housing including an upper surface and projecting rims extending from the housing at opposite edges of the upper surface. A first bracket is adapted for attachment to the overhanging structure and includes a first lip for supporting one of the upper surface rims. A second bracket is in telescoping relation with the first bracket and includes a second lip for supporting the other of the upper surface rims. Springs, or other resilient members, urge the first and second lips toward each other while the relative movement between the first and second brackets is regulated. Regulation of the relative bracket movement may include a restriction in that the relative movement through the use of stops and/or a lock to prevent that relative movement. In a preferred embodiment of the present invention, relative movement restriction and locking is accomplished with a single mechanism.

DETAILED DESCRIPTION OF THE PREFERRED EMBODIMENTS

Figure 1:
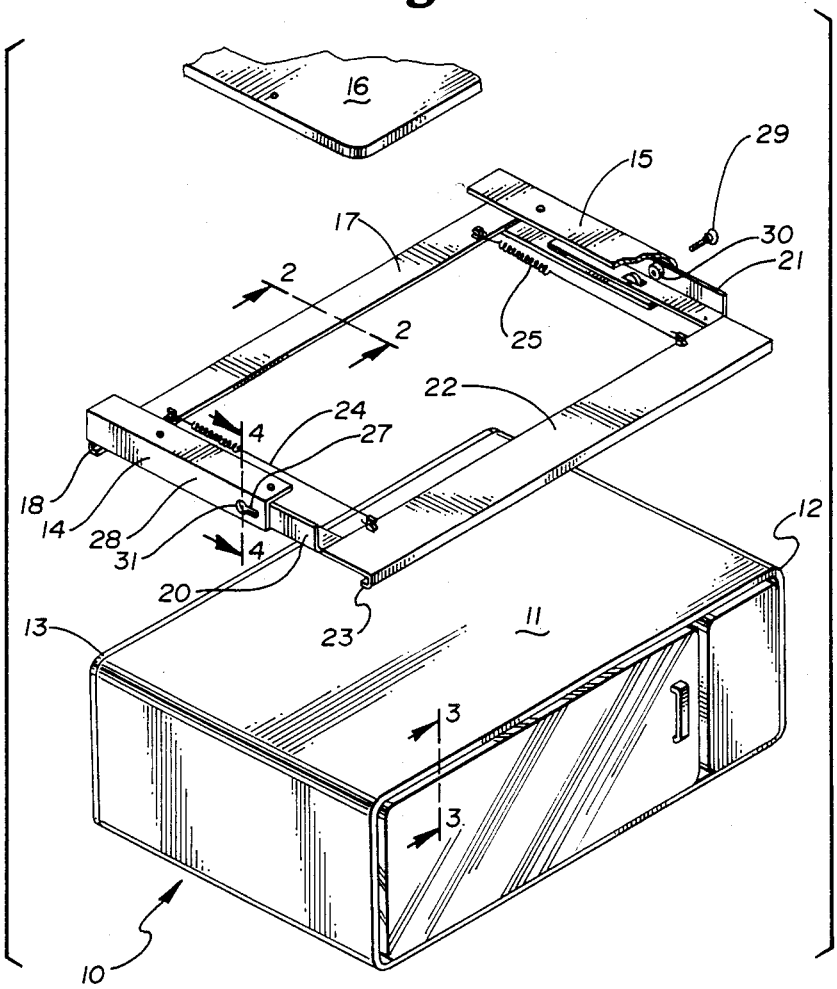
FIG. 1 is a perspective view, and partial cutaway, of a preferred embodiment of the present invention.

A mounting system in accordance with the present invention for mounting an appliance 10, such as a microwave oven, for example is illustrated in FIG. 1. The appliance 10 is of the type having a housing including an upper surface 11 with rims 12 and 13 extending away from the housing in forward and rearward directions, respectively. The rims are described more fully below with reference to FIG. 3.

The mounting system for the appliance 10 includes two channels 14 and 15 which are adapted for securement to an overhanging structure such as a kitchen wall cabinet. The bottom wall of such cabinets provided planar surface to which the mounting system is attached. In some instances, it may be necessary or desirable to employ a mounting plate within the cabinet to distribute the weight over the bottom wall and the same is illustrated in FIG. 1 at 16.

Figure 2:
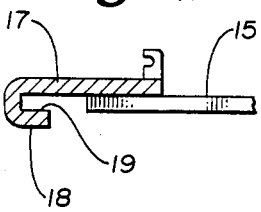
FIG. 2 is a cross section taken along the line 2—2 in FIG. 1.

As will be described more fully below, the channels or rails 14 and 15 are interconnected to form a bracket by a rear support 17 which extends between them and is secured to them, as by welding, for example. In use, the rear support 17 is at or adjacent to the wall on which the overhanging structure (cabinet) is typically mounted. As illustrated in FIG. 2, the rear support includes a lip 18 which defines a groove and provides a supporting surface 19 which will engage and support the rim 13 of the appliance 10, in a manner to be described more fully below.

Another bracket is formed of rails 20 and 21 which are telescoping relation to the channels 14 and 15, respectively. Extending between the rails 20 and 21, and interconnecting them, is a front support 22 which is secured to the rails in any desired manner, as by welding, for example. Front support 22 is configured to provide a lip 23 and groove similar in construction to the lip 18 and groove of rear support 17 to engage and support the rim 12 of the appliacnce 10. The two brackets, as defined above, are provided with springs 24 and 25 which extend between the supports 17 and 22 to urge both supports, and their associated lips, toward each other. The lips are within a plane that is generally parallel with the bottom wall of a cabinet to which the mounting system is attached, as are their associated grooves.

Figure 3:
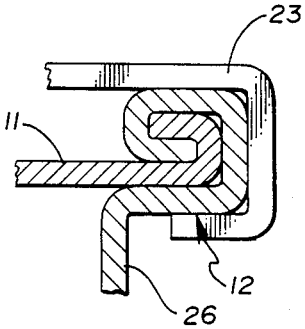
FIG. 3 is a cross section taken along the line 3—3 in FIG. 1.

FIG. 3 illustrates a preferred form by which the rims 12 and 13 may be formed. As illustrated, an extension of the upper surface 11 is "folded" or "rolled" with the corresponding extension of the front surface 26 of the appliance to form the rim 12, in known manner. A lip 23 of support 22 is illustrated in FIG. 3 to show its cooperation with rim 12. Cooperation between the rim 13 and the lip 18 of support 17 may also be illustrated in FIG. 3.

The mounting system described to this point may be used, without enhancement, to suspend an appliance such as a microwave oven. To mount the appliance 10, the channels 14 and 15 are first secured to the overhanging structure, with or without the mounting plate 16, as desired or necessary. The appliance 10 is then lifted and the rim 12 inserted into the groove defined by the lip 23 of support 22 and pulled outwardly against the tension of the springs 24 and 25. The rear of the appliance 10 may then be elevated and the force on the springs 24 and 25 released causing the rim 13 to be supported within the groove defined by the lip 18 of support 17. In this configuration, the appliance 10 may be adequately supported. However, during installation, the force applied against the springs 24 and 25 may cause the rails 21 and 22 to be withdrawn from the channels 14 and 15 respectively. Thus, some limit or restriction on the relative movement between the rails 20 and 21 the channels 14 and 15 is desired. Additionally, once mounted, a force imparted to the appliance 10 as by the opening of a door, for example, may result in a force on the support 22 causing it to move against the urging of the springs 24 and 25 and a withdrawal of the rim 13 from the groove defined by the lip 18. A mechanism by which the two brackets may be locked to prevent relative movement between them is therefore also desirable.

Figure 4:
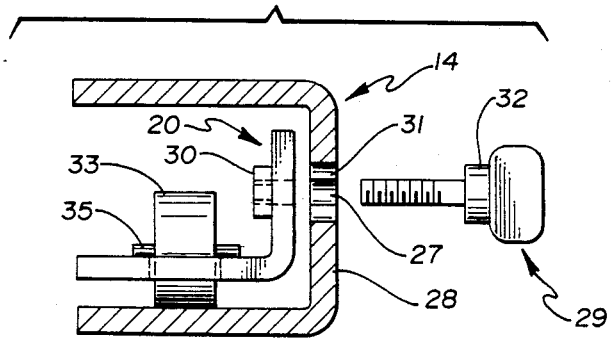
FIG. 4 includes a cross section taken along the line 4—4 in FIG. 1 and illustrates the movement restricting/locking feature of a preferred embodiment of the present invention.

A mechanism by which the relative movement of the two brackets which form a mounting system in accordance with the present invention may be regulated is illustrated in FIG. 4. While FIG. 4 illustrates this mechanism in the context of channel 14 and rail 20, it is to be understood that the same mechanism may be employed in association with the channel 15 and rail 21. Relative motion between the two brackets may be restricted by providing a slot 27 through the side wall 28 of the channel 14 (see also FIG. 1). A threaded member, such as a thumb screw 29 is provided and is configured to extend through the slot 27 and into a threaded member 30 carried by the upstanding leg of the rail 20. In this manner, with the threads of the thumbscrew 29 in engagement with the threaded member 30 through the slot 27, relative motion between the channel 14 and rail 20, as well as channnel 15 and rail 21, is limited or restricted to the extent of the slot 27. This relative motion restriction allows the support 22 to be moved away from the support 17 during mounting of the appliance 10 without withdrawal of the rails 20 and 21 from the channels 14 and 15, respectively.

As illustrated in FIG. 1, the slot 27 includes an enlarged portion 31 which functions, in association with the thumbscrew 29 and threaded member 30, to prevent relative movement between the supports 17 and 22 and, thus, provides a lock mechanism. This is accomplished through a shoulder 32 provided on thumscrew 29 which is configured to engage the enlarged portion 31 of slot 27. When the thumbscrew is inserted through the slot 27 sufficiently such that the shoulder enters the enlarged portion 31 relative movement between the supports 17 and 22 is prevented and the two brackets are locked.

In many instances, it may be desirable to facilitate the relative movement between the channels 14 and 15 and the rails 20 and 21, respectively. Such a system is also illustrated in FIG. 4 wherein a roller 33 is supported for rotational movement about an axle 35, the axle 35 being secured, in any desired manner, to the rail 20. As many rollers of the type illustrated in FIG. 4 as are desired may be employed. As illustrated, the lower leg of the channel 14 provides a race for the rollers 33.

Figure 5:
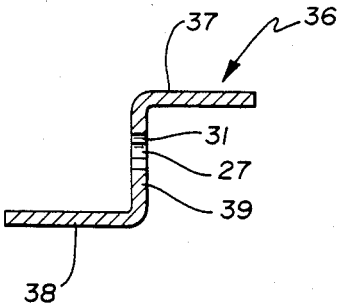
FIG. 5 illustrates an alternative configuration of a portion of the present invention illustrated in FIG. 4 which, in some instances, may be preferred to that illustrated in FIG. 4.

Obviously, many modifications and variations of the present invention are possible in light of above teachings. For example, relative movement between the channels and rails may be facilitated by other anti-friction devices such as bearings, nonslip surfaces, etc. In all cases, one bracket will provide a surface along which the other bracket moves. That surface is referred to herein as a race. Further, in some applications it may be desirable to employ a member configured as illustrated in FIG. 5 at 36 in place of the channels 14 and 15. Both configurations may be referred to herein as channels. FIG. 5 illustrates the alternative member configuration as it would be viewed in cross section taken along the line 4—4 in FIG. 1 with the upper leg 37 providing means for securement to the overhanging structure, the upper surface of the lower leg 38 providing the race and the intermediate wall or leg 39 having the slot 27 and enlarged slot portion 31 therethrough. It is therefore to be understood that the invention may be practiced otherwise than is specifically described.

What is claimed is:

1. In a mounting system for attaching a microwave oven to an overhanging horizontal planar surface, the improvement in combination with a microwave oven comprising:

(a) a first bracket means defining a first plane for attachment to a substantially horizontal overhanging planar surface and including a first grooved member; and (b) a second bracket means having (i) a second parallel grooved member in opposed relationship to said first grooved member, the grooves defining a second plane substantially parallel to and relatively closely spaced apart from said first plane and receiving a pair of parallel projecting edges of the top surface of said microwave oven, the first and second grooved members being moveable relative to each other, and (ii) resilient means urging said first and second grooved members towards each other such that said each of said projecting edges of said top surface is retained in said second plane; and (c) releasable locking means located on a side of one of said first and second brackets and engageable with the other of said brackets to prevent relative movement therebetween such that said top surface of said microwave oven is restrained from disengagement from said first and second grooved members when said locking means is engaged, said locking means operable while said microwave oven is received in said first and second grooved members.

2. In a mounting system for suspending an appliance from an overhanging structure, the improvement in combination with an appliance, said appliance including a housing having a substantially horizontal upper surface and projecting rim means extending away from said housing at opposite edges of said upper surface, comprising:

(a) a first bracket means for attachment to said overhanging structure and including a first lip means supporting one of said upper surface rim means;

(b) a second bracket means in telescoping relation to said first bracket means and including a second lip means supporting the other of said upper surface rim means;

(c) means for resiliently urging said first and second lip means toward each other; and (d) means accessible from a side of said first and second bracket means for regulating the relative movement between said first and second bracket means while said appliance is supported between said first and second lip means.

3. The mounting system of claim 2 wherein said regulating means comprises stop means for restricting the relative movement between said first and second bracket means.

4. The mounting system of claim 3 wherein said regulating means further comprises locking means for preventing relative movement between said first and second bracket means.

5. The mounting system of claim 4 wherein said regulating means comprises slot means within one of said bracket means, key means configured to pass through said slot means and key securing means carried by the other of said bracket means.

6. The mounting system of claim 5 wherein said key means and key securing means comprise means threadedly engageable with each other.

7. The mounting system of claim 6 wherein said slot means includes an enlarged portion, said key means including shoulder means configured to pass into said slot means enlarged portion.

8. The mounting system of claim 2 wherein said regulating means comprised locking means for preventing relative movement between said first and second bracket means.

9. The mounting system of claim 8 wherein said locking means comprises aperture means within one of said bracket means, key means configured to pass through said aperture means and key securing means carried by the other of said bracket means.

10. The mounting system of claim 9 wherein said key means and key securing means comprise means threadedly engageable with each other.

11. The mounting system of claim 2 further comprising means for facilitating telescopic movement between said first and second bracket means.

12. The mounting of claim 11 wherein said facilitating means comprises anti-friction means carried by one of said bracket means, the other of said bracket means including race means engageable by said anti-friction means.

13. The mounting system of claim 12 wherein said anti-friction means comprises roller means.

14. The combination of a microwave oven and mounting system comprising:

(a) a microwave oven having parallel projecting top edges;

(b) first bracket means having a first planar portion adapted to be rigidly secured to an overhanging surface and including a first grooved member;

(c) second bracket means having a second grooved member;

(d) resilient means urging said second grooved member towards said first grooved member; and (e) releaseable locking means located on a side of one of said first and second bracket means and selectively engageable between said first and second grooved members;

such that the first and second grooved members define a second plane substantially parallel to and spaced apart from said first planar portion and receiving the parallel projecting top edges of said microwave oven, wherein said second bracket means slideably supports said second grooved member and said first bracket means rigidly supports said first grooved member such that said second grooved member is permitted to slide in the second plane while said first and second grooved members remain parallel during said sliding motion and further such that said releaseable locking means prevents relative motion between said first and second grooved members when engaged.

15. The mounting system of claim 14 further comprising stop means to limit the sliding motion of said first grooved member to (i) a first position spacing said first and second grooved members apart a distance at least equal to the distance between said projecting edges on the top surface of the oven less the depth of one of the grooves of said grooved members such that the top surface of the microwave oven may be engaged and disengaged from said grooves, and (ii) a second position spacing said first ans second members apart such that the distance between said opposing grooves is substantially equal to said oven top surface distance such that the top surface of the microwave oven may be retained by said grooves.

* * * * *